United States Patent [19]

Bos

[11] 4,335,588

[45] Jun. 22, 1982

[54] YARN PROCESS AND APPARATUS

[75] Inventor: Cornelis Bos, Dieren, Netherlands

[73] Assignee: Akzona Incorporated, Asheville, N.C.

[21] Appl. No.: 866,685

[22] Filed: Jan. 3, 1978

[51] Int. Cl.[3] ..... D04B 35/22

[52] U.S. Cl. ..... 66/125 A; 28/248

[58] Field of Search ..... 66/125 A; 28/248, 252, 28/271

[56] References Cited

U.S. PATENT DOCUMENTS

| | | | |
|---|---|---|---|
| 3,184,820 | 5/1965 | Kanbar | 66/125 A |
| 3,222,859 | 12/1965 | Joly | 28/271 X |
| 3,269,105 | 8/1966 | Eldridge et al. | 28/271 X |
| 3,457,715 | 7/1969 | Eldridge et al. | 28/252 X |
| 3,631,664 | 1/1972 | Mackintosh | 66/125 A X |
| 3,812,668 | 5/1974 | Wilson | 28/271 X |
| 4,000,551 | 1/1977 | Holden | 28/271 |
| 4,134,191 | 1/1979 | Kim et al. | 28/248 |

FOREIGN PATENT DOCUMENTS

| | | | |
|---|---|---|---|
| 825237 | 12/1959 | United Kingdom . | |
| 1060286 | 3/1967 | United Kingdom | 66/125 A |

OTHER PUBLICATIONS

Innes, *The Hosiery Trade Journal*, vol. 80, No. 960, Dec. 1973, p. 131.

*Primary Examiner*—Wm. Carter Reynolds
*Attorney, Agent, or Firm*—Francis W. Young; Tom R. Vestal

[57] ABSTRACT

The invention relates to a process for the treatment on a circular knitting machine of multifilament yarns with a stream of gaseous fluid under superatmospheric pressure, more particularly air, in which treatment the yarns to be knitted are rendered more or less bulky by subjecting them to a blowing treatment in a zone between the point from which the starting yarns are supplied and the point at which they reach the knitting needles.

1 Claim, 1 Drawing Figure

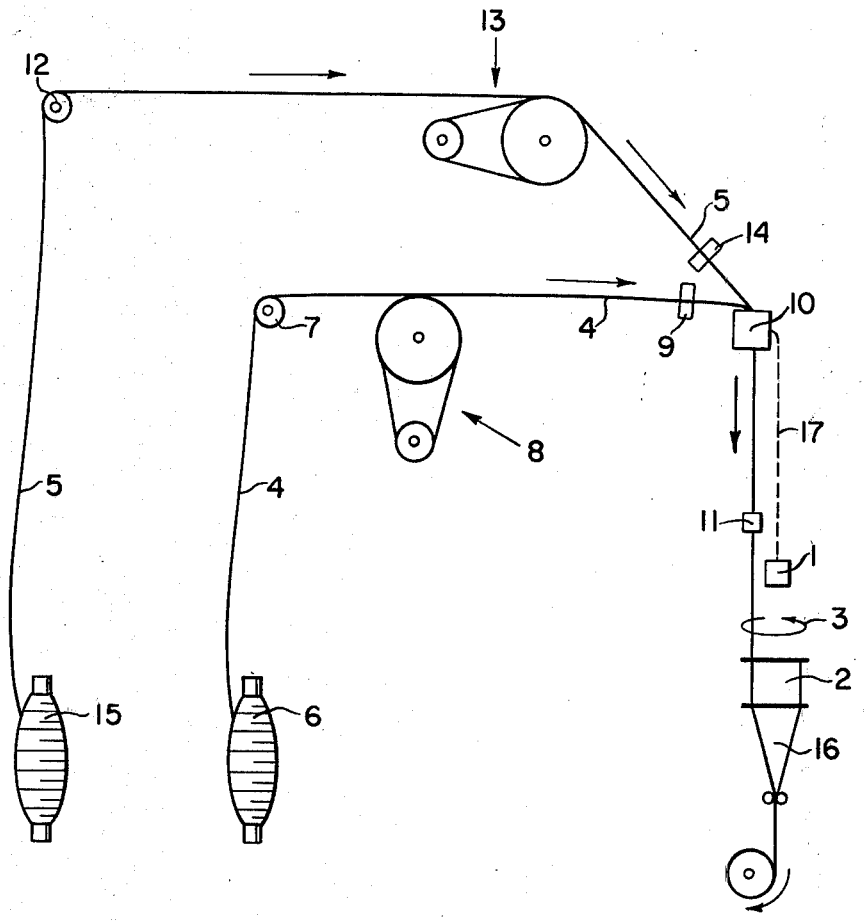
13
12
5
14
10
7
4
9
8
17
5
4
11
1
3
2
15
6
16

YARN PROCESS AND APPARATUS

Reference is made to application Ser. No. 866,684 filed on even date herewith for Tangled Yarn and Process for Making the Same.

In the above-mentioned blowing treatment for making a bulky yarn particularly the formation of more or less closed loops in the yarn is considered. The invention also relates to a circular knitting machine for carrying out said process.

Although a process of the type indicated above may be considered to be generally known from "Deutsche Textiltechnik" 21 (1971), Volume 7, p. 440, right hand column, section 3.6, the process described in it has never been applied on a commercial scale probably because the practical difficulties met in the realization thereof were considered too great, particularly as far as the manufacture of products of acceptable quality was concerned.

The invention has for its object to provide a process of the type indicated above which comprises provisions made for obtaining a good quality circular knit end product. The process according to the invention is characterized in that when the knitting machine is stopped, the supply of the gaseous fluid under pressure is for the duration of a delay time continued after the drive of the needle cylinder of the knitting machine has been switched off.

Consequently, the knitted fabric obtained will not show any deviations formed as a result of interruptions in the knitting process. A simple method according to the invention is characterized in that after the drive, more particularly the drive motor, of the needle cylinder has been switched off, the supply of the gaseous fluid is not stopped until some delay time has passed.

The process according to the invention is with advantage characterized in that the delay time approximately corresponds to the time the needle cylinder takes to come to rest after the drive motor of the needle cylinder has been switched off. According to the invention said delay time may be 1 to 10 seconds, and preferably 2 to 5 seconds. A favorable embodiment is characterized according to the invention in that after the drive motor for the needle cylinder has been switched off, the supply of the gaseous medium is reduced in accordance with a, preferably variable, program, which reduction may optionally be carried out gradually. A very effective process is according to the invention characterized in that after the drive motor for the needle cylinder has been switched off, the reduction of the supply of the gaseous medium under pressure, is controlled, optionally via a transmission device, by the decreasing speed of the needle cylinder as it runs down. The invention also comprises a circular knitting machine for carrying out the above-described process, which machine has a frame provided with takeup and guiding members for the yarn to be processed, and blowing members connected to a supply for a gaseous fluid under pressure, a needle cylinder, a needle cylinder fitted with a plurality of, say, 24 or 48 feeders and brought into rotation with a switch off/on, or engaging/disengaging motor and means for winding the knitted tube, which machine is characterized according to the invention in that means are provided for stopping, via a time delay, the supply of the gaseous fluid under pressure, after the drive for the needle cylinder has been switched off. The means for stopping the fluid supply advantageously comprise a time relay.

A preferred embodiment of the circular knitting machine according to the invention is characterized in that the members for operating the drive of the needle cylinder are by way of a transmission device coupled to control members for the supply of the gaseous fluid under pressure. According to the invention said control members advantageously operate in accordance with a variable program. The invention also comprises a knitted fabric manufactured by the process according to the invention. The invention will be further described with reference to the very schematic drawing representing a circular knitting machine. The cylinder 2 provided with needles can be brought into rotation by means of a motor 1 and is provided with 24 feeders disposed about the periphery of the cylinder. The direction of rotation of the cylinder is indicated by the arrow 3. In the embodiment shown in the drawing two yarns 4 and 5 are fed to each of the feeders.

For the sake of clarity only the supply of yarn to one of the feeders is shown. The yarn 4 is drawn off from a package 6 with flat starting yarn and passes over a thread guide 7 and feed members 8 formed by a forwarding roll with separator roll. Subsequently, on its way to the knitting feeder the yarn 4 passes over a thread guide 11, and a pulling force exerting air texturing device 10 and a thread guide 10, which devices are not shown in detail. For each feeder a special thread guide 9 is mounted in the frame of the knitting machine, and moreover for each feeder there is provided a blower unit 10. The blower units 10 may be approximately of the type described in British Patent No. 825,327. Likewise, the yarn 5 is supplied via its thread guide 12, forwarding members 13 and a second guide 14 to the air texturing device 10. In the blower 10 the yarns 4 and 5 are blown together to form a core-sheath yarn as a result of the tension and the degree of overfeed of the yarns fed to the blower being suitable controlled by setting the forwarding members 8 and 13 to particular speeds. This speed must be such that in the blower 10 the tension in the sheath yarn 5 is lower than in the core yarn 4, whereas the overfeed of the sheath yarn is higher than that of the core yarn. The loops are mainly blown into the polyester filament yarn 5 having latent crimp preferably obtained by asymmetrical heating and/or cooling. The two packages 6 and 15 are formed by flat starting yarn, so that there will be no unwinding difficulties. The tubular knitting 16 produced on the circular knitting machine is discharged from the cylinder in a known manner, wound and in a later stage after-treated in the usual manner. During knitting a member of the loops in the yarn may be severed.

Between the drive of the drive motor 1 for the cylinder 2 and the air-texturing device there is provided a coupling device schematically indicated with a dash line 17. Said coupling device is used, after the drive motor 1 has been switched off, to stop with some suitable and adjustable delay the air supply to the blower 10 in the above indicated way.

The drawing only shows the yarn supply to one of the, for instance, 24 feeders provided in the cylinder 2. When the cylinder contains 24 feeders, than for each feeder there is provided a blower 10 which is mounted on the machine frame. In that case the drive motor 1 must be connected to all 24 blowers by way of identical coupling devices 17.

The delay provided between switching off the drive motor 1 and the stopping of the air supply to the blower 10 to be provided according to the invention by means of the coupling 17 will be of considerable importance when use is made of large amounts of blowing air per unit time required at relatively high yarn speeds of, say, 100–600 m/min., or when the blowing treatment is to be applied to a single filament yarn. After the drive motor has been switched off, the running down time of the cylinder is fairly long as a result of its great mass and relatively high speed.

If at high air speeds per blower the air supply should be continued when the needle cylinder is stationary, then there might not only result streakiness in the knitted fabric but also thread breakage. Then the air treatment of single filament yarns at high knitting speeds would not be feasible in that after each standstill the yarns would have to be rethreaded into the machine.

Within the scope of the invention various modifications may be made. For instance, there may be provided a special buffer vessel with air under pressure, from which air is fed to the blowers upon the drive of the driving motor of the cylinder 2 being switched off. Then simultaneously a valve upstream of the buffer vessel can be closed, as a result of which the air supply to the blowers is similarly retarded. In a somewhat modified embodiment the valve before said buffer vessel is closed with some delay via the time relay, and some time later a valve after the buffer vessel is closed, so that a simple form of programmed stopping of the blowers is obtained. Finally, in a different embodiment a valve controlled by the cylinder speed may be placed in the air line, the control being effected in accordance with a particular program.

What is claimed is:

1. A process for bulking multifilament yarns on a circular knitting machine comprising the steps of feeding at least one multifilament yarn from a yarn supply to a blowing zone, then to a knitting zone; supplying a stream of gaseous fluid under super atmospheric pressure to the blowing zone while a drive for a knitting needle cylinder in said knitting zone is in operation; and gradually reducing the stream of gaseous fluid to the blowing zone after the drive is switched off.

* * * * *